US007338144B2

(12) United States Patent
Mantell et al.

(10) Patent No.: US 7,338,144 B2
(45) Date of Patent: Mar. 4, 2008

(54) INK JET PRINTER HAVING PRINT HEAD WITH PARTIAL NOZZLE REDUNDANCY

(75) Inventors: David A. Mantell, Rochester, NY (US); Jeffrey J. Folkins, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 317 days.

(21) Appl. No.: 11/238,764

(22) Filed: Sep. 29, 2005

(65) Prior Publication Data

US 2007/0070108 A1 Mar. 29, 2007

(51) Int. Cl.
*B41J 2/01* (2006.01)

(52) U.S. Cl. ..... 347/19

(58) Field of Classification Search ..... 347/19, 347/188; 400/120.09
See application file for complete search history.

(56) References Cited

U.S. PATENT DOCUMENTS

| | | | | |
|---|---|---|---|---|
| 3,946,398 | A | 3/1976 | Kyser et al. | |
| 4,907,013 | A | 3/1990 | Hubbard et al. | |
| 4,963,882 | A | 10/1990 | Hickman | |
| 5,581,284 | A | 12/1996 | Hermanson | |
| 5,640,183 | A | 6/1997 | Hackleman | |
| 6,215,557 | B1 | 4/2001 | Owens | |
| 6,481,816 | B1 * | 11/2002 | Oyen | 347/12 |
| 6,508,531 | B1 * | 1/2003 | Gargir | 347/19 |
| 6,695,435 | B1 | 2/2004 | Cheng et al. | |
| 6,739,690 | B1 | 5/2004 | Darling | |
| 2004/0119766 | A1 * | 6/2004 | Shibata et al. | 347/12 |
| 2005/0105105 | A1 | 5/2005 | Vestjens et al. | |
| 2005/0116981 | A1 | 6/2005 | Faken et al. | |

* cited by examiner

*Primary Examiner*—Huan Tran
(74) *Attorney, Agent, or Firm*—Maginot, Moore & Beck

(57) ABSTRACT

An ink jet printer has a print head with partial nozzle redundancy. All of the nozzles are used for printing, but at a less than maximum available ejection output. When a failed or impaired nozzle is identified, the normal ejection output is increased for neighboring nozzles, so that pixels to be printed by the impaired nozzle are printed by neighboring nozzles at previously blank pixels. Printing pixels by neighboring non-failed nozzles mitigates the visible effect of the nozzle failure and prevents loss of productivity.

21 Claims, 10 Drawing Sheets

INK JET PRINTER HAVING PRINT HEAD WITH PARTIAL NOZZLE REDUNDANCY

BACKGROUND

An exemplary embodiment of this application relates to ink jet printing by a print head having partial nozzle redundancy for the purpose of compensating for failed or malfunctioning nozzles. More particularly, an exemplary embodiment relates to an ink jet printer having print head with partial nozzle redundancy that ejects ink droplets from all of the nozzles while printing, but is operated at less than maximum available droplet ejection throughput. The print head nozzles are checked for malfunctioning, and the printing to be performed by any detected malfunctioning nozzle is compensated for by nearby nozzles that have their droplet ejection throughput increased to provide additional droplets.

Droplet-on-demand ink jet printing systems eject ink droplets from print head nozzles in response to pressure pulses generated within the print head by either piezoelectric devices or thermal transducers, such as resistors. The ejected ink droplets are propelled to specific locations on a recording surface, commonly referred to as pixels, where each ink droplet forms a dot or spot thereon. The print heads have arrays of droplet ejecting nozzles and a plurality of ink containing channels, usually one channel for each nozzle, which interconnect an ink reservoir in the print head with the nozzles.

In a typical piezoelectric ink jet printing system, the pressure pulses that eject liquid ink droplets are produced by applying electric pulses to the piezoelectric devices, causing bending or deforming to pressurize the volume of liquid ink in contact therewith. When a voltage pulse is applied to a selected piezoelectric device, a quantity of ink is displaced from the ink channel and a droplet of ink is mechanically ejected from the nozzle associated with that piezoelectric device. Just as in thermal ink jet printing, the ejected droplets are propelled to pixel targets on a recording surface to form an image of information thereon. The respective channels from which the ink droplets were ejected are refilled by capillary action from an ink supply. For an example of a piezoelectric ink jet printer, refer to U.S. Pat. No. 6,739,690 or U.S. Pat. No. 3,946,398.

As is well known, there are two basic ink jet printing configurations; viz., printing an image on an intermediate surface (usually a drum) for subsequent transfer to a recording medium and printing an image directly on a recording medium. For each of these two basic configurations, there are ink jet architectures for printing the image in a single pass or printing the image in multiple passes. For multiple pass architectures, the same pixels can be addressed multiple times or each pixel can be addressed only once. For each of the single and multiple pass architectures, the print head may scan the print head over the image receiving surface to print the image or the recording medium may be scanned past a print head while the print head prints the image thereon. Additionally, the print head may scan in one direction or scan bi-directionally. It is the intent of this application for the print head disclosed herein to apply to any of the above architectures for which the same pixels can be addressed only once.

Ink jet printing technologies suffer from reliability concerns where individual droplet ejecting nozzles can fail or malfunction on a print head. The failure of a single nozzle generally can force the replacement of an entire print head. Most nozzle failures are caused by external contamination, such as contaminants in ink or manufacturing debris and the nozzle failures are generally proportional to print throughput, so the higher the printing volume, the more likely a nozzle will fail. The result of a single failed nozzle can require the replacement of a print head because the resulting missing line or column of pixels is visually objectionable. There have been many attempts in the ink jet industry to compensate for missing nozzles without having to replace the print heads. Examples of ink jet printers having systems that compensate for missing or malfunctioning nozzles without the need of replacing the print heads are disclosed below.

US Patent Publication Nos. 20050105105 and 20050116981 disclose a printer, a computer program, and a method to camouflage defective print elements in a print head having a plurality of print elements.

U.S. Pat. No. 4,907,013 discloses means and circuitry for detecting a malfunctioning nozzle in an array of nozzles in the ink jet print head. If the printer processor is unable to compensate for the malfunctioning nozzle by stepping the print head and using non-malfunctioning nozzles during subsequent passes over the print medium, the printer is shut down.

U.S. Pat. No. 4,963,882 discloses using multiple nozzles per pixel location. In one embodiment, two ink droplets of the same color are deposited upon a single pixel location from two different nozzles during two passes of the print head. A failure of one of the two nozzles printing each pixel does not prevent at least some color for each pixel, so that totally missing pixels are prevented.

U.S. Pat. No. 5,581,284 discloses a method for identifying any failed nozzle in a full width array print bar of a multicolor printer and substituting at least one droplet from a nozzle in another print bar having a different color of ink. The substitute fill in with a droplet having a different color of ink prevents a missing spot in the printed information, so that print bar replacement is avoided.

U.S. Pat. No. 5,640,183 discloses a number of droplet ejecting nozzles are added to the standard column of nozzles in a nozzle array, so that a number of redundant nozzles are added at the ends of each column of nozzles. The print head is shifted regularly or pseudo-randomly such that a different set of nozzles prints over the first printed swath during a subsequent pass of the print head in a multi-pass printing system.

U.S. Pat. No. 6,215,557 discloses a system for identifying faulty ink jet nozzles in an ink jet print head based upon evaluation of a test pattern printed by the print head. The system generates a faulty nozzle record and the printer controller or printer driver alters the print data to print the desired image using only good nozzles.

U.S. Pat. No. 6,695,435 discloses a method for selectively printing a pixel at a print location having a missing color caused by a failed or impaired nozzle in a print bar of a multicolor printer. The method includes determining which colors are to be printed based on a color value for the missing color pixel and selecting at least one color in the place of the missing color pixel based on a pseudo-random process. The color of some neighboring pixels may be changed to include a combination of colors that include the missing color.

SUMMARY

According to aspects illustrated herein, there is provided an ink jet printer having a print head with partially redundant nozzles. The printer uses a printing system that prints with all of the nozzles, but with less than full throughput on average in solid fill images. When a failed or impaired nozzle is identified, the throughput or duty cycle of the nozzles that print pixels adjacent the missing pixels intended to be printed by a failed nozzle is increased. Thus, different but adjacent blank pixels are printed to compensate for the missing pixels not printed by the failed nozzle without loss of productivity. Though the average droplet ejection rate or firing frequency remains the same for all functioning nozzles in the print head, the throughput or duty cycle of the print head is nominally less than the maximum available throughput, but greater than 50% thereof. Thus, not every nozzle in the print head ejects an ink droplet during each duty cycle. However, to compensate for failed nozzles, the duty cycle or throughput of the non-failed nozzles that print pixels adjacent missing pixels intended to be printed by a failed nozzle is increased in order to print at a previously blank pixels nearest to the missing pixels not printed by the failed nozzle.

In one aspect of the exemplary embodiment, there is provided a method of printing by an ink jet printer having an array of nozzles in a print head that is capable of compensating for a failed nozzle, comprising: providing a print head or print heads having an array of nozzles that includes partial nozzle redundancy; operating said print head or print heads at less than maximum throughput or droplet ejecting output; determining if a nozzle in said array of nozzles has failed; selecting non-failed nozzles that print pixels that are adjacent missing pixels intended to be printed by said failed nozzle; and increasing the droplet ejection throughput thereof, so that missing pixels to be printed by the failed nozzle are substituted for pixels printed by the selected non-failed nozzles, thereby compensating for said missing pixels to be printed by the failed nozzle and preventing loss of productivity by said print head.

BRIEF DESCRIPTION OF THE DRAWINGS

An exemplary embodiment of this application will now be described, by way of example, with reference to the accompanying drawings, in which like reference numerals refer to like elements, and in which.

DESCRIPTION OF THE PREFERRED EMBODIMENT

Figure 1:
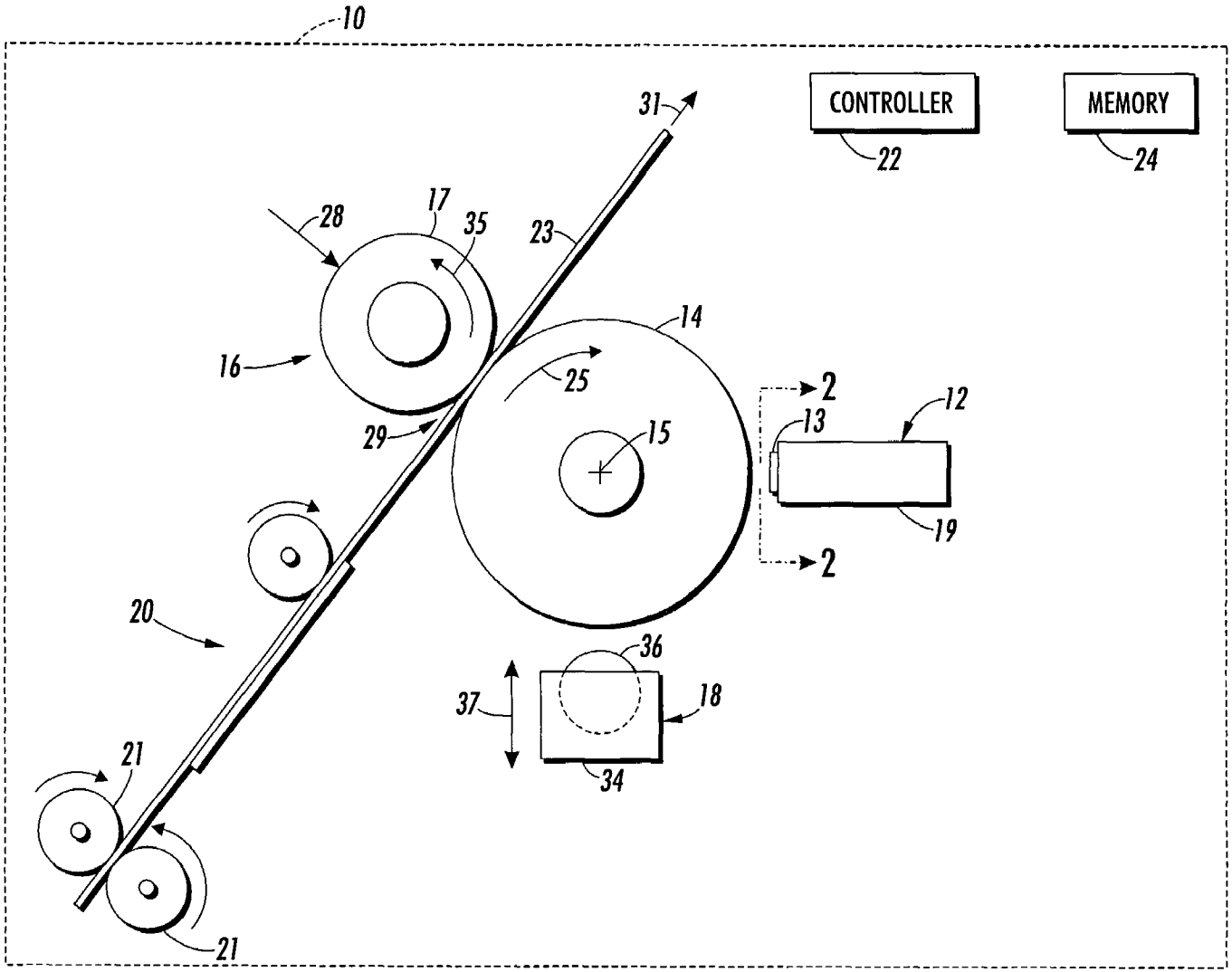
FIG. 1 is a schematic, side elevation view of an ink jet printer having a print head with partial nozzle redundancy.

For a general understanding of an ink jet device, such as, for example, a solid ink jet printer in which the features of the exemplary embodiment of this application are incorporated, reference is made to FIG. 1. As shown in FIG. 1, the ink jet printer 10 includes, in part, a print head 12, a rotary image receiving member in the form of an intermediate transfer drum 14, a transfixing station 16 having a movable transfixing roll 17, a release agent applicator 18, a recording medium transport assembly 20 with a pair of pre-heating rolls 21, a controller 22 and a memory 24.

The memory 24 may include, for example, any appropriate combination of alterable, volatile or non-volatile memory, or non-alterable or fixed memory. The alterable memory, whether volatile or non-volatile, can be implemented using any one or more of static or dynamic RAM, a disk drive, a writeable or re-writeable optical disk and disk drive, a hard drive, flash memory or the like. Similarly, the non-alterable or fixed memory can be implemented using any one or more of ROM, PROM, EPROM, EEPROM, an optical ROM, such as CD-ROM or DVD-ROM disk, and disk drive or the like. It should also be appreciated that the controller 22 and/or memory 24 may be a combination of a number of component controllers or memories all or part of which may be located outside the printer 10.

The solid ink jet printer 10 shown in FIG. 1 is a schematic side elevation view that depicts a rotary image receiving member in the form of an intermediate transfer drum 16 having axis 15 and a stationary full width print head 12 that is mounted adjacent and parallel thereto. As discussed later with respect to FIG. 8, an alternate embodiment of the application is shown as ink jet printer 30. Printer 30 has an image receiving member that is a cylindrical member or drum 32 on which a recording medium 23 may be temporarily wrapped around and held for direct printing thereon. The recording medium 23 is removed from the cylindrical member 32 by a stripper finger 33 after the required number of passes of the cylindrical member to complete the printed image.

Figure 2:
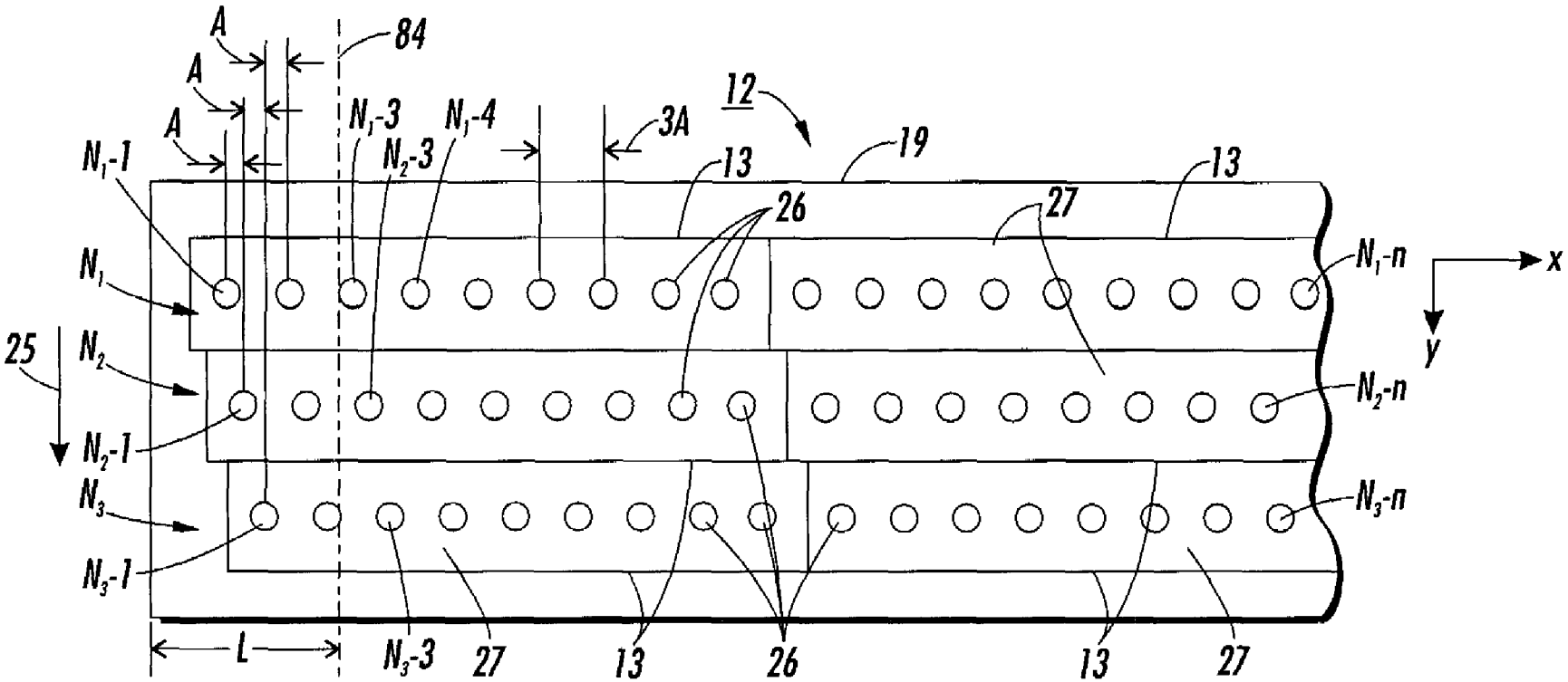
FIG. 2 is a partially shown front view of the print head as viewed along view line 2-2 in FIG. 1.

With continued reference to FIG. 1, in which one exemplary embodiment of this application is shown, the stationary print head 12 is parallel to the axis 15 of the intermediate transfer drum. The print head is under the control of the controller 22 and is composed of a plurality of print head sub units 13 that are mounted on a structural bar 19. Referring also to FIG. 2, a partially shown front view of the print head 12 is depicted, as viewed along view line 2-2 in FIG. 1, wherein the print head sub units 13 are identical and are mounted on the structural bar 19 in three adjacent, parallel rows. The sub units in each row are abutted end-to-end along the length of the structural bar 19. Each print head sub unit has a linear array of droplet ejecting nozzles 26 in a nozzle face 27 that confronts the intermediate transfer drum 14. The center-to-center spacing between each nozzle in each array and between adjacent nozzles of adjacent sub units in each row is, for example, 200 nozzles per inch. Thus, the arrays of nozzles 26 in each row of sub units 13 form three page width rows of nozzles $N_1$, $N_2$, $N_3$ that are each capable of printing 200 dots per inch (dpi). Each row of nozzles $N_1$, $N_2$, $N_3$ is offset from an adjacent row of nozzles by the distance as indicated by dimension "A" (where, for example, A could equal 1/600 of an inch). The nozzles 26 in each row $N_1$, $N_2$, $N_3$ are equally spaced apart with their center-to-center distance as "3A". The print head sub units 13 comprise only a body or die having ink flow directing channels (not shown), ink droplet ejecting piezoelectric devices (not shown), and an array of droplet ejecting nozzles 26 that are connected to the channels. The ink distribution system (not shown) for the print head 12 and the electrical driving circuitry (not shown) may be positioned anywhere along the structural bar 19. As a result, under control of the controller 22, the nozzles 26 in each row of the print head sub units 13 on the structural bar 19 may selectively eject ink droplets onto the intermediate transfer drum 16. Of course, two off set rows of sub units with a nozzle spacing of 300 nozzles per inch could be used, as well as a single row of sub units having a nozzle spacing of 600 nozzles per inch, so long as less than maximum throughput is used for the average nominal duty cycle, thereby providing some nozzle redundancy which could be used for maximum throughput when desired to compensate for missing pixels caused by a failed nozzle.

As the intermediate transfer drum 14 rotates past the print head 12 in the direction of arrow 25 or Y direction, the rows of nozzles $N_1$, $N_2$, $N_3$ eject ink droplets on demand at an average nominal throughput of 400 dpi, which is less than the maximum available droplet ejection throughput of 600 dpi. This nominal droplet ejection throughput is greater than 0.5 of the maximum available throughput, but less than the maximum throughput. In a single pass architecture as shown in FIG. 2, the nozzles 26 in the first row of print head sub units 13 that is passed by the rotating intermediate transfer drum 14 in the direction of arrow 25 has been identified as $N_1$. The nozzles 26 of the second row of print head sub units 13 has been identified as $N_2$, and the nozzles of the third row of print head sub units has been identified as $N_3$. The nozzles 26 in the first row $N_1$ may be sequentially numbered, beginning from the left side to the right side in the X direction, as $N_1$-1 through $N_1$-n, while the nozzles in the second row $N_2$ may be numbered $N_2$-1 through $N_2$-n, and the nozzles in the third row $N_3$ may be numbered $N_3$-1 through $N_3$-n. Ink droplets are selectively ejected from nozzles 26 onto the intermediate transfer drum 14 and the whole image is formed thereon during each revolution thereof. If maximum throughput or droplet ejection output were used, the print head 12 would print at 600 dpi in the X direction. When printing at, for example, ⅔ of maximum throughput, this effective 600 ⅔×600 dpi printing resolution would provide the same average mass per area as a nominal 400×600 dpi printing resolution. While ink droplets are being deposited on the intermediate transfer drum 14, the transfixing roll 17 at the transfixing station 16 may remain in contact with the intermediate transfer drum for a single pass drum architecture.

Referring again to FIG. 1, when a complete image has been printed on the intermediate drum 14, under control of the controller 22 and associated memory 24, the exemplary ink jet printer 10 converts to a printer configuration for transferring and fixing the printed image to a recording medium 23 at the transfixing station 16. According to this configuration, the transfixing roll 17 at transfixing station 16 is moved from a spaced location toward the intermediate transfer drum 14 in the direction of arrow 28 to form the transfixing nip 29. A sheet of recording medium 23 is transported by transport 20, under control of the controller 22, to the transfixing station 16 and then through a nip 29, as indicated by arrow 31. The transfixing roll 17 applies pressure against the back side of the recording medium 23 in order to press the front side of the recording medium against the intermediate transfer drum. Although the transfixing roll 17 may also be heated, in this exemplary embodiment, it is not. Instead, the transport 20 contains a pair of pre-heating rolls 21 for the recording medium 23. The pre-heating rolls 21 provide the necessary heat to the recording medium 23 for subsequent aid in transfixing the image thereto, thus simplifying the design of the transfixing roll 17. The pressure created by the transfixing roll 17 on the back side of the heated recording medium 23 facilitates the transfixing (transfer and fusing) of the image from the intermediate transfer drum 14 onto the recording medium 23.

The rotation or rolling of both the intermediate transfer drum 14 and transfixing roll 17, as shown by arrows 25,35 respectively, not only transfix the images onto the recording medium, but also assist in transporting the recording medium through the nip 29 formed between them. This transporting assistance by the rolling intermediate transfer drum 14 and transfixing roll 17 is especially needed after the trailing edge of the recording medium 23 leaves the recording medium transport 20.

Once an image is transferred from the intermediate transfer drum 14 and transfixed to a recording medium 23, the transfixing roll 17 may be moved away from the intermediate transfer drum and the intermediate transfer drum continues to rotate. Under the control of the controller 22, any residual ink left on the intermediate transfer drum is removed by well-known drum maintenance procedures at a maintenance station, not shown. Also, periodic applications of release agent (not shown), such as, for example, silicone oil, are applied to the surface of the intermediate transfer drum by the release agent applicator 18, under control of the controller 22, prior to subsequent printing of images on the intermediate transfer drum by the print head 12. Typically, the release agent applicator 18 includes a container 34 of release agent (not shown) and a resilient porous roll 36 rotatably mounted in the container and in contact with the release agent. The porous roll 36 is periodically moved into and out of temporary contact with the rotating intermediate drum to coat the surface thereof as needed by the controller 22, as indicated by arrow 37.

Figure 3:
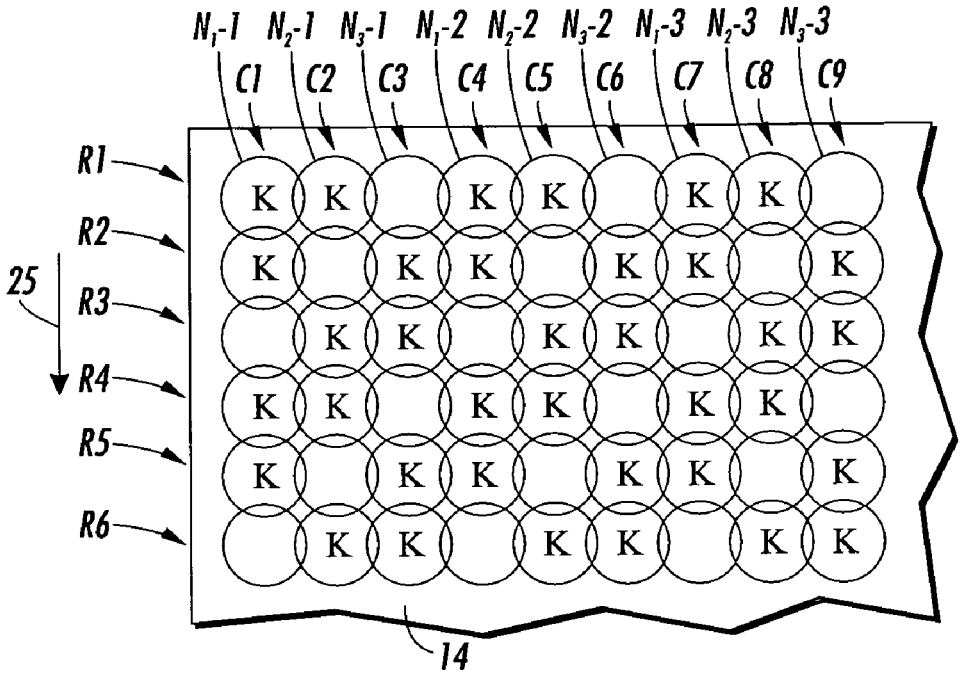
FIG. 3 is a schematic illustration of the printing of a solid fill area by the average nominal throughput by the print head shown in FIG. 2.
Figure 8:
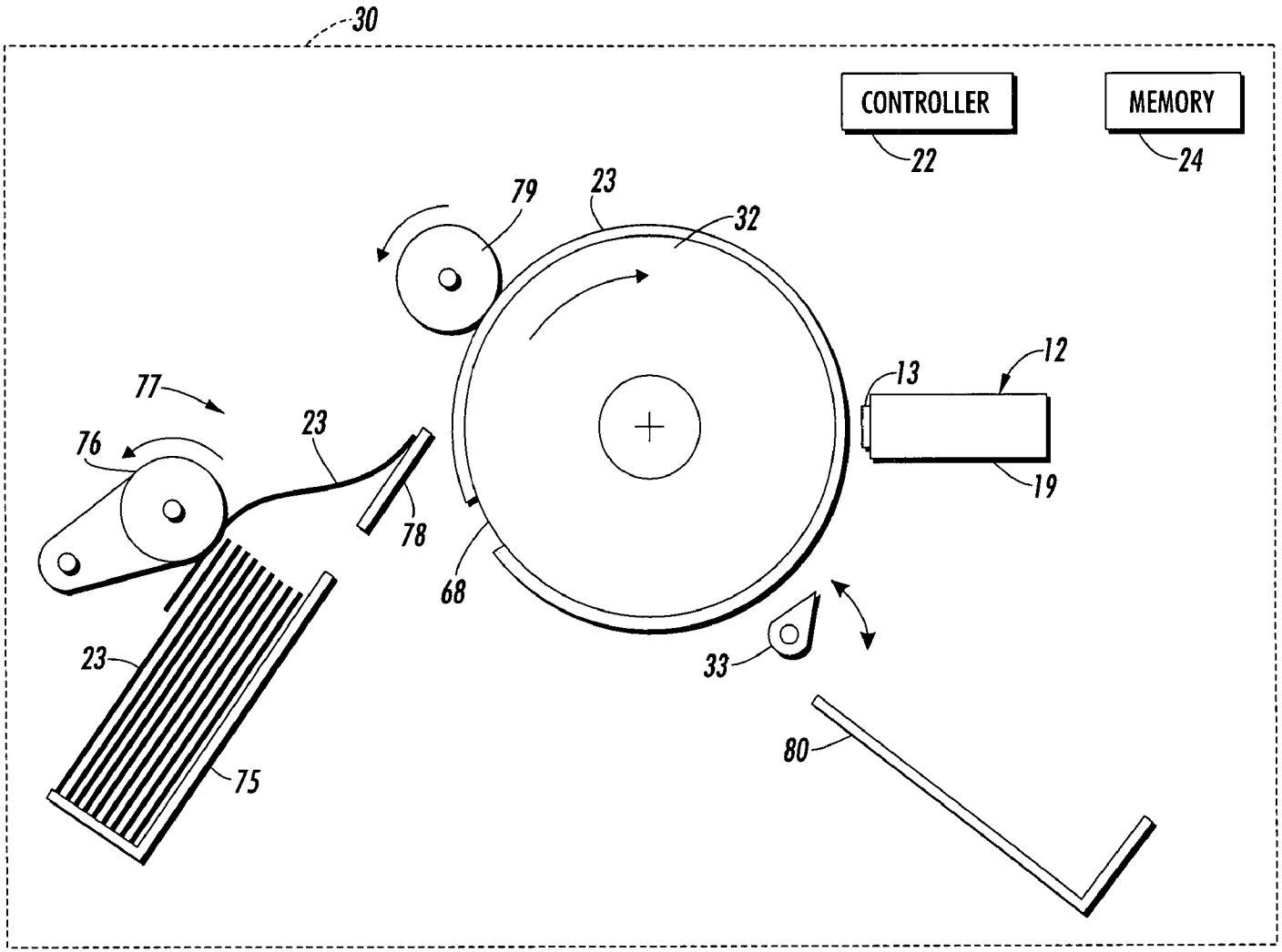
FIG. 8 is a view similar to FIG. 1 showing an alternate embodiment of an ink jet printer wherein the printing is directly on a recording medium held on a rotating cylindrical member.

The printer controller 22 in cooperation with the memory 24 of the printer 10 determines the pattern of spots or dots representing the image that are to be printed by ejecting an ink droplet for each spot or pixel to be printed. The image is divided into a raster pattern of pixels that are loaded into the memory 24 for use by the controller 22. The controller in response to the pixel pattern in the memory causes the proper nozzle 26 in print head 12 to eject an ink droplet at the proper moment as the intermediate transfer drum 14 rotates past the print head 12. A convenient way to think of the development of the printed image on the intermediate transfer drum is in terms of an assembly of rows of pixel locations, as illustrated in FIG. 3. In this FIG. 3, each row of pixels is indicated by a row of circles representing target pixels to be printed on the intermediate transfer drum or recording medium 23, if the printer 30 of FIG. 8 is used. Each row is identified as R1 through R6.

In FIG. 3, a schematic illustration of the printing of a solid area by the print head 12 is shown using a throughput or duty cycle of ⅔ of the maximum available throughput. This ⅔ of a duty cycle is representative of a normal operating throughput available in a range of greater than 0.5 to 0.8 of the maximum operating duty cycle or throughput of the print head 12. Though multicolor printing using the printing system of this application is available by providing an aligned print head for each color, only one print head using black ink is described herein for sake of clarity. As the intermediate transfer drum 14 rotates past the print head 12, as indicated by arrow 25, the activated nozzles 26 eject ink droplets at ⅔ throughput and print a dot or spot of black ink represented by "K" in each circle or pixel. In the embodiment described above, three rows of off set print head sub units 13 may eject an ink droplet from two out of every three nozzles, as one example of printing at ⅔ of the maximum available print head throughput. The first row R1 of printed pixels is printed using only the nozzles of nozzle rows $N_1$ and $N_2$, the second row R2 is printed using only nozzles of nozzle rows $N_1$ and $N_3$, and the third row R3 is printed using only nozzles of nozzle rows $N_2$ and $N_3$. The cycle is repeated for each subsequent three rows of printed pixels; namely, row 4 is the repeat of row R1, etc.

A sufficiently suitable ink jet printing quality is 400×600 dpi, meaning 400 dpi in the "X" direction and 600 dpi in the process or "Y" direction. This could involve two sequential and off set print heads, each having an array of nozzles at 300 nozzles per inch and therefore capable of printing 600 dpi. Thus, a maximum throughput of 2×300=600 dpi is available, but in accordance with an exemplary embodiment, an average nominal printing throughput would be at ⅔×600 dpi or 400 dpi. A conventional, fully redundant architecture would require a complete second set of two sequential and off set print heads for a total of four print heads. The nozzles of the second set of print heads would be aligned in the X direction and with the nozzles of the first set of print heads. In this manner, if a given nozzle fails, a second nozzle that has been placed exactly in line with the failed nozzle can be utilized to restore the image quality. Thus, each pixel may be addressed twice. The reliability of such a fully redundant system is significantly improved, but unfortunately at such a high price that it is impractical for most single pass printers.

There are numerous problems with providing a back up print head having 100% fully redundant nozzles as a solution for one or more failed or impaired nozzles in the primary print head. If the nozzles are added to the same print head, the cost of such print heads will likely increase by more than a factor of two. Typically, print heads are built at the practical limit of their manufacturability, so that print heads having a factor of two more nozzles is often beyond the current technology. A more practical approach is to add aligned redundant print heads. Even this places new restraints on the manufacturing tolerances for each print head. This is because the overall length of the print heads must be controlled so that the alignment of the nozzles in both the primary print head and the redundant print head is maintained from one end of each print head to the other. The overall length and nozzle spacing of abutted print head sub units may be accomplished, for example, as disclosed in U.S. Pat. No. 5,198,054, incorporated herein by reference. Otherwise, the varying alignment would create severe artifacts. Trying to align nozzles perfectly from one print head to another is the most difficult of all possible methods as our eyes are particularly sensitive to the types of defects generated by interleaving nozzles that are nominally supposed to print a straight line with respect to each other.

One known solution to compensate for failed or impaired nozzles is to use a printing mode that prints in multiple passes over the same target pixels on the recording medium. In such cases it is possible to avoid failed or impaired nozzles by filling in the missing printed pixels using working nozzles during subsequent passes of the print head. The problem with this approach is that single pass modes cannot be used, and in multiple pass modes, the overall speed of the printer is reduced by a factor of at least two. Furthermore, the text quality can be degraded if the registration of the passes is not great.

The embodiment of this application uses neither complete redundancy nor multiple passes over the same pixel locations. For the solid area coverage illustrated in FIG. 3, the three sequential rows of 200 dpi print head sub units 13 are off set to produce printing at the resolution of 600 dpi in the X direction, when the ink droplets are ejected at full throughput or duty cycle. However, in the embodiment of this application, the three rows of print head sub units 13 eject droplets during a normal printing operation on an average of ⅔ of maximum available throughput, meaning on average only two out of every three adjacent droplet-ejecting nozzles would eject an ink droplet. The resulting printing resolution is effectively about 400×600 dpi and would provide the same average mass per area coverage as the nominal 600×400 dpi. In the illustration of FIG. 3, the first row R1 of pixels of the solid area to be printed would be printed by droplets ejected from the following nozzles: from left to right, $N_1$-1, $N_2$-1, $N_3$-1 (no ejection); $N_1$-2, $N_2$-2, $N_3$-3 (no ejection); etc. The following row R2 would be printed by nozzles $N_1$-1, $N_2$-1 (no ejection), $N_3$-1; $N_1$-2, $N_2$-2 (no ejection), $N_3$-2; etc. Row R3 would be printed by nozzles $N_1$-1 (no ejection), $N_2$-1, $N_3$-1; $N_1$-2 (no ejection), $N_2$-2, $N_3$-2; etc. Accordingly, each pixel location on the image receiving surface, viz., the intermediate transfer drum 14 in FIG. 3, may be identified by a row (for example, R1) and a column (for example, C1 which would be printed by nozzle $N_1$-1).

Figure 4:
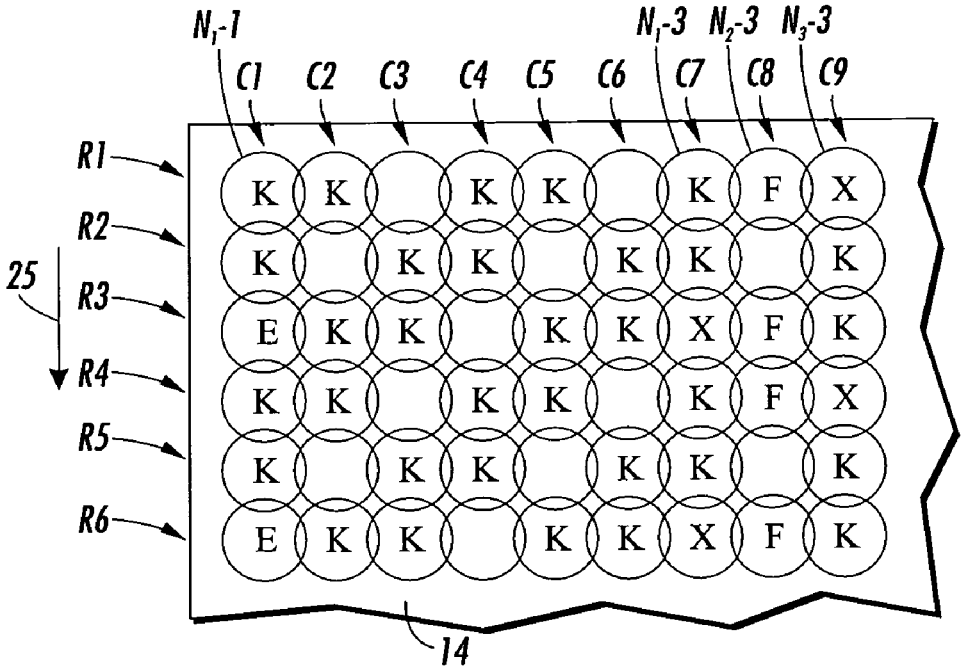
FIG. 4 is a schematic illustration similar to FIG. 3, showing the missing pixels that result from a failed nozzle and the compensating pixels that replaced the missing pixels.

Referring now to FIG. 4, a schematic illustration similar to FIG. 3, but showing the missing printed pixels, as indicated by "F," that result from failed nozzle $N_2$-3, as an example. As soon as nozzle $N_2$-3 has been identified as failed or impaired, it is inactivated and the nozzles $N_1$-3 and $N_3$-3 that print ink droplets before and after the missing pixels intended to be printed by the failed or impaired nozzle $N_2$-3 will have their ejection output increased to the maximum available throughput. In a single pass printer architecture, the nozzles which print before and after the missing pixels that were intended to be printed by failed nozzle $N_2$-3 are nozzles that are adjacent the failed nozzle. Thus, the pixels in column C8 would not be printed. However, pixel columns C7 and C9 that are printed by nozzles $N_1$-3 and $N_3$-3 would not only print their pixels as identified by K, but also the remaining blank pixels in those columns as identified by X. Accordingly, the pixels identified with an X would compensate for the missing pixels identified with an F. This compensation provides about the same amount of ink on average in that region as before the nozzle $N_2$-3 failed. Such compensation works well for high enough X-direction resolutions and/or ink spot spread systems, where the neighboring compensation for the missing nozzle is not visible as a defect; that is, the effect is below the visual eye response. For typical dot or spot spreads, this is generally the case in the 400 to 600 dpi range and higher dpi regions.

In the case where pattern images are not solid area images, especially those images having edges with slanted lines, the nozzles printing in that region could have their throughput increased from ⅔ to maximum available throughput. This is illustrated in column C1 printed by nozzle $N_1$-1 where the normally omitted pixels are printed, as indicated by "E." By enabling non-solid fill images to print at up to the maximum throughput, the effective dpi resolution of these halftones, edges, text and line portions of images can become the full 600×600 dpi. Thus, many edge image quality artifacts are much improved. This provides an optimum situation with a high resolution printing for text, edge and line images requiring high resolution, and the missing nozzle redundancy needed for the less resolution dependent but more missing nozzle defect dependent solid fill portions of the image. The precise pattern in FIG. 3 is provided as an illustration. Solid area coverage for this method need not be as precisely patterned as shown. Well known typical error diffusion or half-toning techniques as used in ink jet printers may be additionally used to provide more random patterns of dots, which can still be moved to blank pixel locations nearby those pixels that are not printed by a malfunctioning nozzle.

Alternatively, the raw signals of an image, prior to rendering to dots, can be shifted to neighboring lines, and then the image is subsequently processed with an adaptive rendering technique, such as, for example, error diffusion. In this case, the original image does not contain any intensities greater than 0.5 to 0.8 of the maximum available throughput, so that in the subsequent adaptive rendering step that becomes the maximum average coverage without a failed nozzle. When a failed nozzle is identified and compensated for, the signal for the failed nozzle is reduced to zero and the signals of the lines on either side neighboring the failed nozzle are increased to compensate for the signal that was originally assigned to the failed nozzle. For example, the signal assigned to the failed nozzle is split and added to the nearest neighbor pixels that are not printed by the failed nozzle. If that signal exceeds the maximum allowed, the excess can be added to other nearby neighbors. In a subsequent error diffusion step, the ink droplets that would have been printed by the failed nozzle will be printed by its neighboring nozzles.

Figure 5:
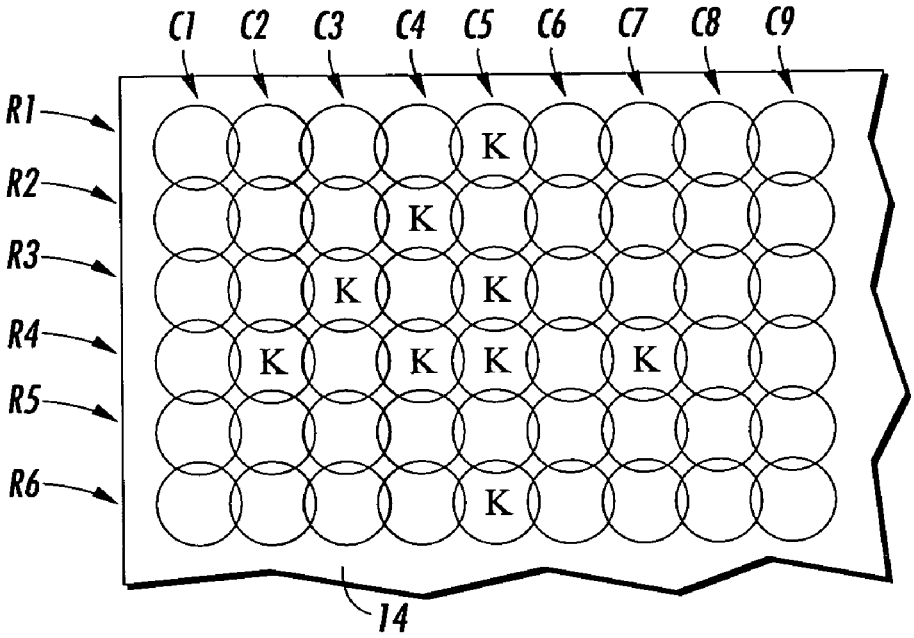
FIG. 5 is a schematic illustration of printing by the print head of FIG. 2 for a non-solid fill area using the average nominal throughput of the print head.
Figure 6:
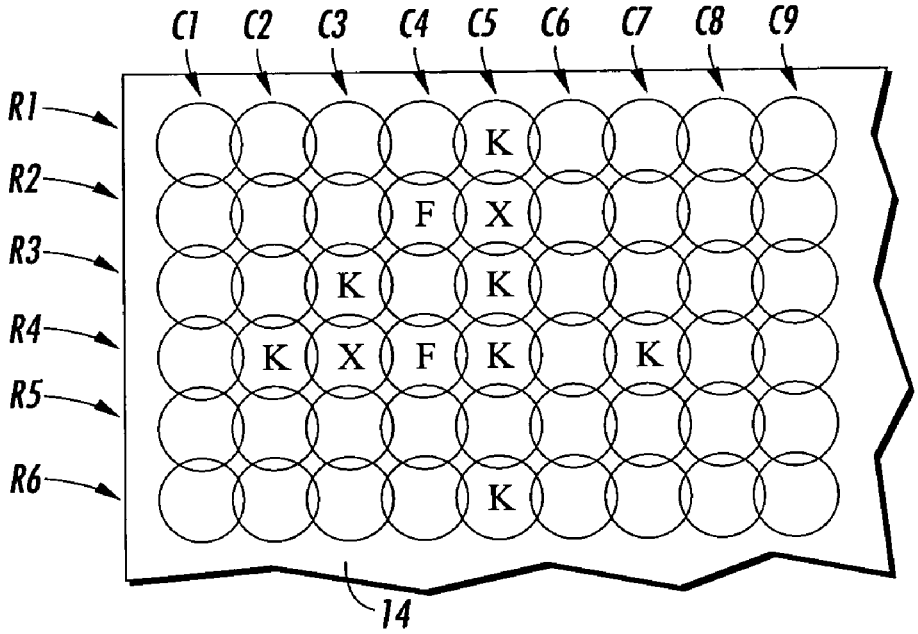
FIG. 6 is a schematic illustration of the non-solid fill area printing similar to FIG. 5, but showing the missing pixels that result from a failed nozzle and the compensating pixels that replaced the missing pixels.

In FIG. 5, a schematic illustration of a non-solid area image is depicted in the form of the numeral four (4) that has been printed by print head 12 with no malfunctioning nozzles. The same available pixel coverage has been used in FIG. 5 as described in FIGS. 3 and 4 for the sake of clarity. Because the print head 12 is printing at ⅔ of the maximum throughput, pixels at locations R2/C5, R4/C3, R4/C6, and R5/C5 might be missing. In contrast, FIG. 6 is a schematic illustration of the non-solid area printing similar to FIG. 5, but showing the missing pixels at locations R2/C4 and R4/C4 as indicated by F in those pixels. The missing pixels were caused by the failure of nozzle $N_1$-2. Upon detection of malfunctioning nozzle $N_1$-2, the nozzles printing before and after this nozzle, viz., nozzles $N_3$-1 and $N_2$-2, have their normal operating throughput increased to the maximum available throughput. This results in the printing of the pixels indicated by X, and as discussed above, compensates for the missing pixels identified as F caused by malfunctioning nozzle $N_1$-2. Pixels at R2/C5 and R4/C3 are the nearest available blank pixels for printing by nozzles $N_3$-1 and $N_2$-2, when operating at maximum throughput. These pixels will, therefore, be printed to compensate for the missing pixels R2/C4 and R4/C4.

Figure 9:
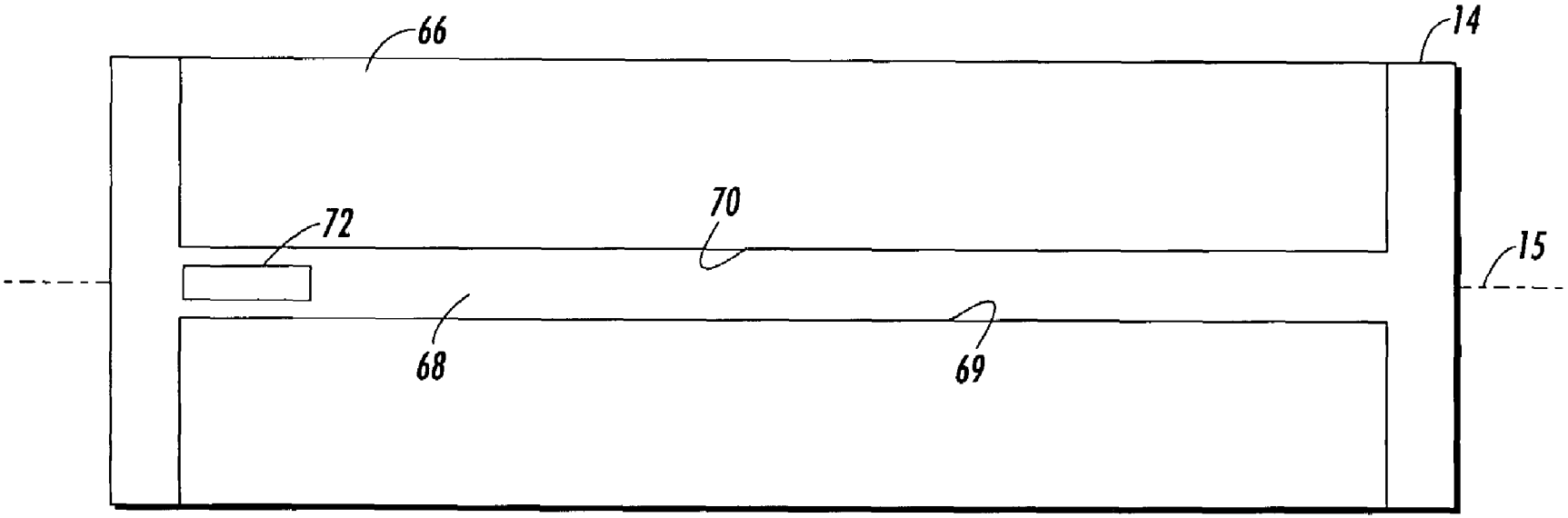
FIG. 9 is a view of the intermediate transfer drum showing an inter-document zone.

In FIG. 9, a front view of the intermediate transfer drum 14 is shown as it would be viewed from the print head 12. As is well known in the ink jet industry, an inter-document zone 68 may be produced between the leading edge 69 and trailing edge 70 of an image 66 printed on the intermediate transfer drum 14. In this inter-document zone 68, a test patch 72 may be printed by the print head nozzles 26, and the test patch may be scanned by an optical sensor (not shown). The test patch 72 may be printed by one or more print head sub units 13 or may be printed by the entire print head 12. Any missing pixel detected in the test patch 72 by either the optical sensor or by comparing the printed test patch with a reference patch stored in the memory 24 identifies the malfunctioning nozzle and triggers a compensation algorithm stored in the memory. This compensation algorithm instructs the controller 22 to increase the droplet ejection throughput of the nozzles that print before and after the failed or impaired nozzle based on the intended image content of the malfunctioning nozzle.

Figure 7:
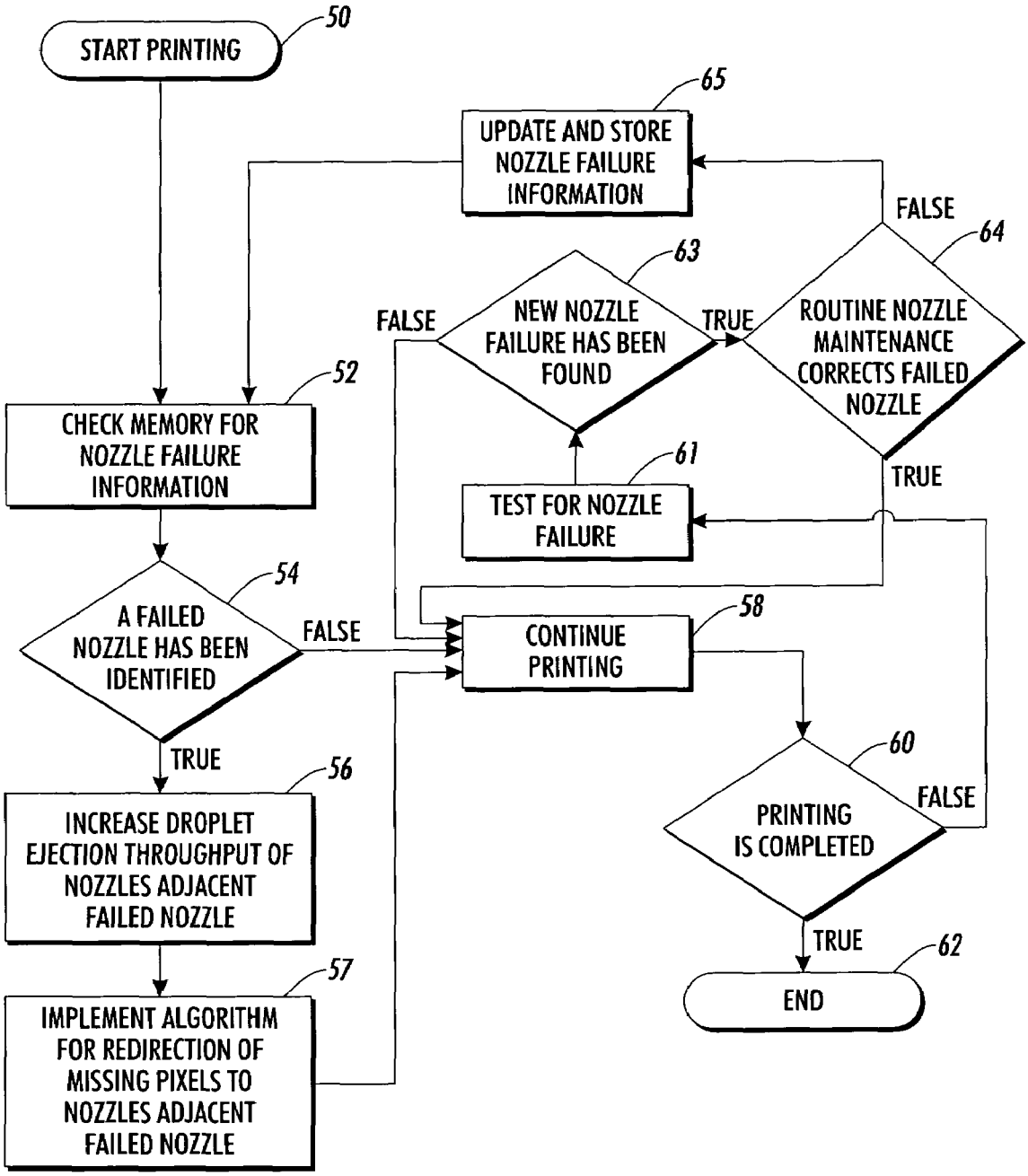
FIG. 7 is a schematic flow diagram of a procedure for compensating for missing pixels caused by a failed nozzle in the print head.

Referring to FIG. 7, a schematic flow diagram is depicted of a procedure for compensating for missing pixels caused by one failed or impaired nozzle in the print head 12. The print head 12 has partial nozzle redundancy, and, in the embodiment disclosed, has a 50% nozzle redundancy. All of the nozzles in the print head 12 are used, but the ejection output or throughput is less than maximum available throughput. For the embodiment disclosed, the print head 12 has three parallel, horizontal rows of nozzles each having a spacing of 200 dpi with a normal operating throughput of ⅔ of the maximum available throughput. The procedure includes checking for failed or impaired nozzles and, when a failed or impaired nozzle is detected, the compensating procedure for missing pixels would be implemented. Of course, when a nozzle tasked with printing a dot on a selected pixel on the intermediate transfer drum or recording medium has been determined to be inoperative or malfunctioning, the result would be a scan line or pixel column that has missing printed pixels. Where a nozzle has been detected to be malfunctioning, the pixels that would have been printed are redirected to the nearby nozzles, so that generally on average the number of pixels actually printed is about the same as was originally intended. The algorithm for this redirection will be based on minimizing any possible viewed image quality defects.

With continued reference to FIG. 7, printing is initiated by the printer 10 at 50. At 52, controller 22 checks memory 24 for stored information on identified malfunctioning or failed nozzles that could not be cleared or corrected by routine print head maintenance. If no failed or impaired nozzle has been identified when the memory 24 has been checked at 54, printing is continued at 58. If a failed or impaired nozzle is identified at 54, then at 56 it is disabled. The effective droplet ejection throughput of the working nozzles identified that print pixels immediately before and after the missing pixels intended to be printed by the failed nozzle is increased to the maximum available throughput. The pixels that would have been printed by the failed nozzle are remapped or redirected to one of the identified working nozzles. The remapping can also be done to the original image, so that the original signal is moved to nearby pixels. This may then be followed by an error diffusion algorithm or other adaptive screening technique that would place dots preferentially in the darker regions and avoid placing dots in the region cleared in the original image that is to be printed by the missing or failed nozzle. The mapping or redirection does not necessarily have to be one-to-one; i.e., the number of pixels printed by the nozzles that print pixels adjacent missing pixels need not equal the intended total pixels for the image. Rather the imaging processing algorithm mapping should be designed to minimize visual defects and artifacts.

Additionally, if an imperfection is observed in the printing by a printer operator, a test for nozzle failure may be initiated at 61 by the printer operator at any time. Otherwise, at 61, the print head 12 is checked for failed or impaired nozzles periodically during a printing operation. Any suitable method for identifying a failed or malfunctioning nozzle is sufficient, such as printing a test patch 72 in the inter-document zone 68 (FIG. 9) and scanning the test patch 72 with an optical sensor (not shown). The sensor may directly indicate a missing pixel in the test patch and identify the failed or impaired nozzle or the sensor may transmit the sensed test patch to the memory 24 for comparison with a reference patch to determine the malfunctioning nozzle. When a failed or impaired nozzle is first detected by either the test patch 72 at 61 or visually by an operator, routine maintenance is performed at 64. If the failed nozzle has been corrected, printing is continued at 58. If the failed nozzle has not been corrected by the routine maintenance, the identified failed nozzle information is updated and stored in memory 24 at 65.

To assure acceptable printing continues to be accomplished during a printing operation, a test patch 72 is periodically produced in the inter-document zone 68 at 61. Once a failed or impaired nozzle is identified, the information stored in memory 24 is updated at 65. Once compensation for a failed or impaired nozzle not corrected by routine maintenance is accomplished, printing is continued at 58. When the printing has been completed at 60, the printer is stopped at 62. If no failed or impaired nozzle is detected after the procedure checks for one, printing is continued at 58 with periodic tests for malfunctioning nozzles at 61, until the printing is completed and the procedure is stopped at 62.

In FIG. 8, a schematic, side elevation view of an alternate embodiment of the ink jet printer 10 in FIG. 1 is shown as ink jet printer 30. This ink jet printer 30 includes, in part, a printer controller 22 and memory 24, a print head 12 comprising a stationary print bar 19 with three off set rows of print head sub units 13 thereon, just as in FIG. 2, and a rotary image receiving member in the form of a rotatable cylindrical member or drum 32. A recording medium 23 is temporarily attached to the cylindrical drum 32 for direct printing thereon by the print head 12. As described above, the print head 12 has three rows of nozzles 26 having a nozzle density of 200 dpi, each row of nozzles being off set from each other. A paper supply tray 75 has a stack of recording medium 23 thereon, such as, for example, paper, and a sheet feeding roll 76 feeds the recording medium 23 seriatim from the supply tray 75 to a transport system 77. The transport system 77 has a transport guide 78 and a transport roller 79 for transporting and directing each recording medium 23 onto the cylindrical drum 32.

The recording medium 23 is wrapped around and held onto the outer surface of the cylindrical drum 32 by any suitable means (not shown), such as, for example, by electrostatic attraction or by a vacuum. As described with reference to FIG. 1, the print head 12 of printer 30 functions in substantially the same way. The print head 12 of printer 30 prints directly on the recording medium 23 on the cylindrical drum 32. After the printed image is completed, the recording medium with the image printed thereon is removed by a pivoting stripper finger 33 that is controlled by the controller 22. After being stripped by the stripper finger 33, the recording medium 23 with the printed image is placed in a collection tray 80.

In the same manner as in ink jet printer 10, the ink distribution system and electrical drive circuitry (neither shown) are located at any convenient place on the print bar 19. Each of the print head sub units 13, as discussed above, is only a die or body containing ink flow channels with associated piezoelectric devices and the array of nozzles connected to the channels. The main difference between ink jet printer 30 and ink jet printer 10 is that the print head 12 of printer 30 print images directly on a recording medium 23 attached to the cylindrical drum 32, while the print head 12 of ink jet printer 10 print images on the intermediate transfer drum 14 and the images must subsequently be transferred to a recording medium 23.

The print head could also be a scanning type print head (not shown) that is transported on a carriage (not shown) across the receiving member that may be either the recording medium on a cylindrical drum or an intermediate transfer drum. In such a configuration, the receiving member would be held stationary while the print head prints a swath of information in a direction parallel to the receiving member. After a swath of information is printed, the receiving member is stepped a distance of at most equal to the height of the printed swath. Then the print head is again scanned across the temporarily stationary receiving member and the receiving member stepped after each swath is printed until the image is completely printed.

Additionally, any of the systems described above could be used in a multiple pass interlaced type printing system in which target pixels are addressed only once and the print head actually has a total "M" resolution less than the desired printed resolution. The desired resolution is achieved by translating the print head slightly and sending it over the image receiving surface additional times to effectively create multiples of the base resolution. For example, if the print head only had a resolution of 100 nozzles per inch total but a printed resolution of 600 dpi was desired, then the image could be formed in six passes with slight print head translations to create the effective 600 dpi. In this case, if a nozzle fails, the same technique as previously described can be used. In this case the nozzles that print pixels adjacent the missing pixels intended to be printed by the failed nozzle are not physically adjacent nozzles, but are simply the print head nozzles which end up printing adjacent pixels to the missing pixels. The printing adjacent nozzles might even be different physical nozzles on each of the different printing passes.

Figure 10:
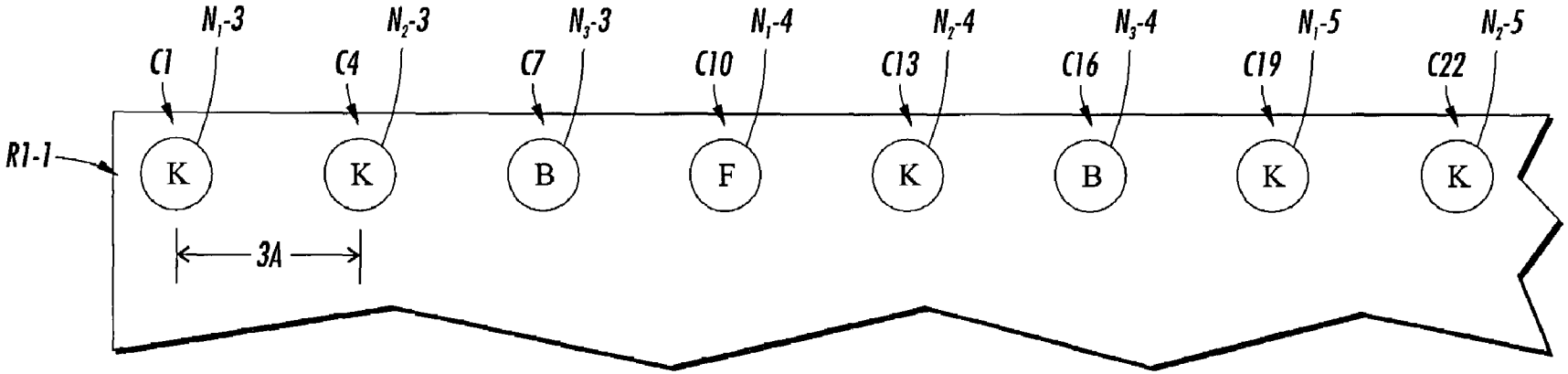
FIGS. 10 to 12 are schematic illustrations of printing by a multiple pass ink jet printer in which a solid fill area is printed with an average, less than maximum throughput from a translatable print head similar to the print head shown is FIG. 2.
Figure 11:
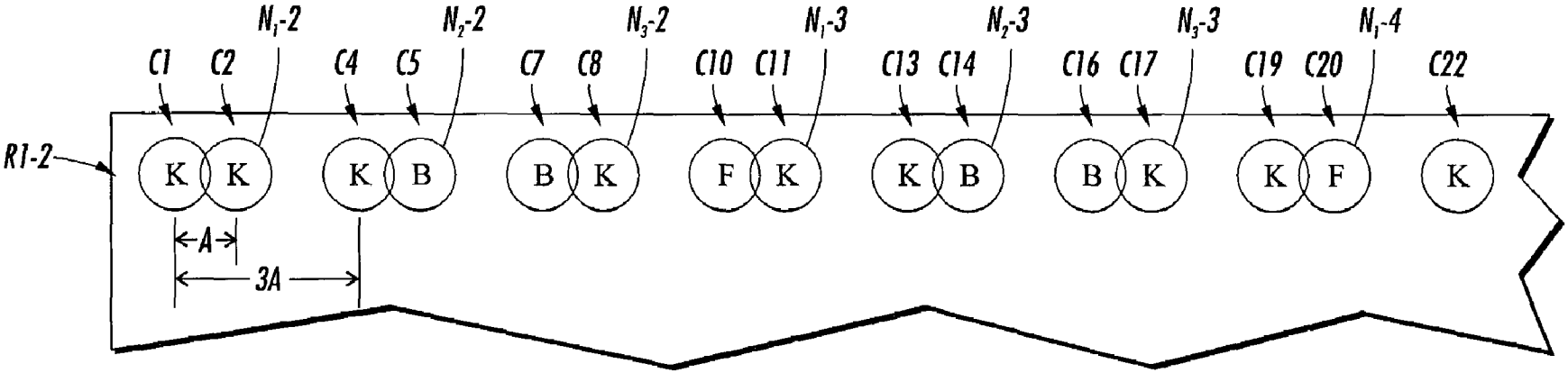
Figure 12:
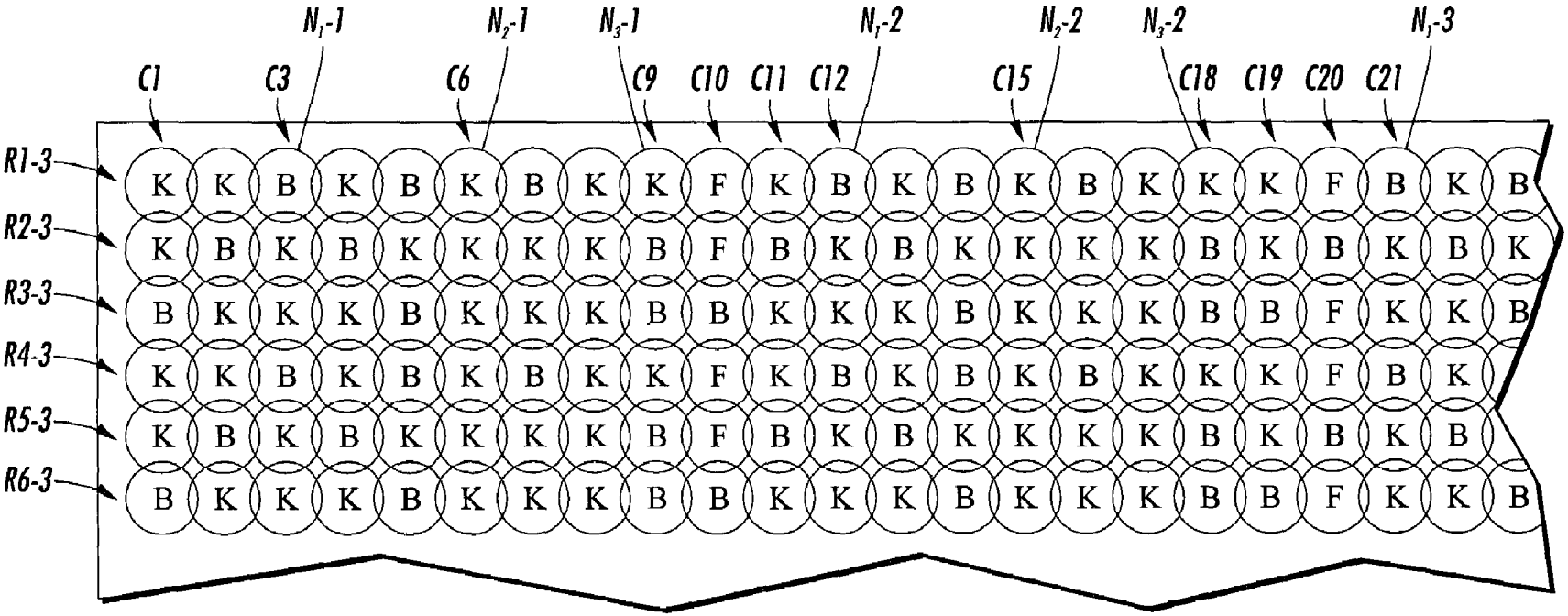

For a specific example of multiple pass printing, refer to FIGS. 10 to 12, where schematic illustrations of such printing are shown in detail. For one exemplary multiple pass printing system, a print head similar to the print head 12 in FIG. 2 may be used. Referring to FIG. 2, the print head 12, when used in a multiple pass architecture, would be translatable in the X direction for a predetermined distance after each pass of the intermediate transfer drum 14 or cylindrical member 32. Prior to initiation of printing, the translatable print head in a multiple pass architecture would be off set a predetermined distance (or number of nozzles) from the edge of the intermediate transfer drum or cylindrical member (or printing zone thereon), as indicated by the dashed line 84 that represents them. The number of passes designated for the multiple pass architecture would determine the minimum off set distance "L" by the print head.

The printing system that produces the solid fill area printing as illustrated in FIGS. 10 to 12 would have a three pass architecture. The print head for a multiple pass architecture would have a center-to-center nozzle spacing larger than a print head for a single pass architecture. For the example of printing shown, A is equal to 1/600 of an inch, and the center-to-center nozzle spacing would be 9A, while the rows of nozzles $N_1$, $N_2$, and $N_3$ would be off set from each other by the distance 3A.

After the first pass of the intermediate transfer drum 14 (or cylindrical member 32), the first row of printed pixels R1-1 (the first pass for row one) is partially shown in FIG. 10. In this printing example, the print head would print with a throughput of 2/3 of maximum throughput, so that nozzles 26 in nozzle rows $N_1$ and $N_2$ would eject ink droplets and nozzle row $N_3$ would not. Accordingly, with the print head off set by the distance L prior to initiation of printing, the pixels printed in the first pass R1-1 would be printed by nozzles $N_1$-3, $N_2$-3, $N_3$-3 (blank), $N_1$-4 (failed), $N_2$-4, $N_3$-4 (blank), $N_1$-5, $N_2$-5, etc. These printed or addressed pixels may be identified as R1-1/C1, R1-1/C4, R1-1/C7, etc.

Prior to the second pass, the print head would be translated the distance of 10A (1‰ inch) in the X direction during the passage of the inter-document zone 68 (see FIG. 9). Alternatively, the intermediate transfer drum 14 or cylindrical member 32 could be stopped during the print head 12 translation. After the second pass, the first row R1-2, partially shown in FIG. 11, would be printed. In this second pass, nozzles 26 in nozzle rows $N_1$ and $N_3$ would eject ink droplets and nozzles in nozzle row $N_2$ would not. Accordingly, the pixels printed in the second pass would be printed by nozzles $N_1$-2, $N_2$-2 (blank), $N_3$-2, $N_1$-3, $N_2$-3 (blank), $N_3$-3, $N_1$-4 (failed), etc.

Prior to the third pass, the print head would be translated the distance of 10A in the X direction. After the third pass is completed, the first row of pixels R1 is completed and is identified as R1-3 in FIG. 12. In this third pass, nozzle rows $N_2$ and $N_3$ print and nozzle row $N_1$ does not. Thus, the pixels R1-3/C3, R1-3/C6, R1-3/C9, etc., are printed by nozzles $N_1$-1 (blank), $N_2$-1, $N_3$-1, $N_1$-2 (blank), $N_2$-2, $N_3$-2, $N_1$-3 (blank), etc. The second row R2-3 is shown after having been printed by three passes and two translations of the print head. Nozzles in nozzle row $N_2$ did not print in the first pass, nozzles in row $N_1$ did not print in the second pass, and nozzles in nozzle row $N_3$ did not print in the third pass. The third row R3-3 is shown after having been printed by three passes and two translations of the print head. Nozzles in nozzle row $N_1$ did not print in the first pass, nozzles in nozzle row $N_2$ did not print in the second pass, and nozzles in nozzle row $N_3$ did not print in the third pass. The remaining rows of pixels are printed by repeating the above printing algorithm, so that row R4-1 is the same as R1-1, row R5-1 is the same as R2-3, and row R6-3 is the same as R3-3, etc.

Therefore, the same compensation technique for camouflaging missing pixels as described above for a single pass ink jet architecture may be used for a multiple pass ink jet architecture. Both architectures only address a pixel once. In a printer having a single pass architecture, adjacent nozzles on both sides of a failed nozzle have their throughput increased to print available blank pixels. In a printer having a multiple pass architecture, the nozzles which print pixels adjacent the missing pixels that were intended to be printed by a failed nozzle have their throughput increased to print available blank pixels. In this later case, it is not physically adjacent nozzles that print pixels adjacent the missing pixels. Though a single failed nozzle in a single pass architecture will produce only one missing line or column of pixels, a single failed nozzle in a multiple pass architecture may produce a missing line or column of pixels in each pass. Thus, a three pass printing system will produce three lines of missing pixels that are spaced from each other. Because the multiple lines of missing pixels are spaced from each other, the compensating algorithm used in single pass systems also works for each of the three lines of missing pixels produced by the three pass printing system.

In FIG. 12, failed nozzle $N_1$-4 causes a line of missing pixels at columns C10 and C20 in the portion of the printed image. Therefore, the throughput of nozzles $N_3$-1 and $N_1$-3 are increased to compensate for missing pixels in column C10 and the throughput of nozzles $N_1$-5 and $N_1$-3 are increased to compensate for missing pixels at column C20. Blank pixels are available at R2-3/C9, R2-3/C11, R3-3/C9, R5-3/C11, and R6-3/C9 and may be printed to compensate for missing pixels in column C10. Similarly, available blank pixels R1-3/C21, R3-3/C19, R4-3/C21, and R6-3/C19 may be printed to compensate for the missing pixels in column C20.

The same technique described in FIG. 7 for compensating for missing pixels caused by a failed nozzle is applicable for the multiple pass printing architecture described with reference to FIGS. 10 to 12.

Of course, an exact 50% nozzle redundancy and the three for two compensation described in the representative embodiment above need not be adhered to exactly. The same concept can be applied to systems with additional resolution of anything less than 2× (100% redundancy) all the way down to 1× (the lower limit would be determined by the ability of spot spread of the ink droplet on the recording medium to compensate not just for the nearest pixels, but next nearest neighbors and so on).

In summary, a compensation system for an ink jet printer, upon detection of one or more failed or impaired nozzles, compensates for such failed nozzles with the nearest neighboring nozzles without loss of productivity. Additionally, the non-failed nozzles eject ink droplets on average at a throughput between greater than 0.5 to 0.8 of the maximum available ejection output or throughput of the nozzles at any point while printing the image. This, for example, would give the solid area image mass as greater than 0.5 to 0.8 of the image compensating maximum available throughput. Any time two or more adjacent nozzles malfunction and cannot be recovered by routine maintenance, the printer is shut down for printer service.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method of printing images by an ink jet printer having a print head: with an array of nozzles capable of compensating for a failed nozzle, comprising:

providing a print head having an array of nozzles that includes a partial nozzle redundancy;

ejecting ink droplets from all of said nozzles in said print head at an ejection throughput that is on average 0.5 to 0.8 of a maximum available throughput of said print head while printing an image without a failed nozzle;

determining if a nozzle in said array of nozzles has failed;

identifying missing pixels intended to be printed by a failed nozzle;

selecting non-failed nozzles that print pixels neighboring said missing pixels;

increasing the ejection throughput of said selected non-failed nozzles; and printing nearest available blank pixels that neighbor said missing pixels identified as intended to be printed by said failed nozzle using said selected non-failed nozzles in order to mitigate visible effects produced by said failed nozzle and prevent lost of productivity.

2. The method of printing as claimed in claim 1, wherein said step of increasing the ejection throughput further comprises:

increasing the ejection throughput of said selected non-failed nozzles to said maximum available throughput whenever said pixels identified to be printed by said failed nozzle are to be printed in a substantially dark fill.

3. The method of printing as claimed in claim 1, wherein said step of determining if a nozzle has failed further comprises:

storing nozzle failure information in a memory accessible by a printer controller;

checking said memory by said controller upon initiation of a printing operation for nozzle failure information; and continuing printing operation if no failed nozzle information is stored in said memory.

4. The method of printing as claimed in claim 3, wherein said method further comprises:

periodically checking said print head for a new nozzle failure during said printing operation and continuing the printing operation if no nozzle failure is located;

identifying any new nozzle failure located during said periodic checking;

performing routine maintenance on said print head to correct a failed nozzle located during said periodic checking and continuing the printing operation if said failed nozzle is corrected; and updating said stored nozzle failure information in said memory if said failed nozzle cannot be corrected by said routine maintenance.

5. The method of printing as claimed in claim 4, wherein the method further comprises:

ejecting ink droplets onto a rotatable intermediate transfer drum to form an image thereon for subsequent transfer to a recording medium.

6. The method of printing as claimed in claim 5, wherein said ejecting of ink droplets to form said image on said intermediate transfer drum is accomplished in a single pass; and wherein each of the pixels of said image may be addressed only once for printing by said print head.

7. The method of printing as claimed in claim 5, wherein said ejecting of ink droplets to form said image on said intermediate transfer drum is accomplished in two or more passes; and wherein each of the pixels of said image may be addressed only once for printing by said print head.

8. The method of printing as claimed in claim 4, wherein the method further comprises:

ejecting ink droplets directly onto a recording medium to print said image thereon, said recording medium being held on a rotatable cylindrical drum during said printing of said image; and removing said recording medium with said image printed thereon from said cylindrical drum upon completion of printing of said image.

9. The method of printing as claimed in claim 4, wherein the method further comprises:

ejecting ink droplets directly onto a recording medium to print said image thereon, said ejecting of ink droplets being accomplished in a single pass, and each of the pixels of said image being addressed only once for printing by said print head.

10. The method of printing as claimed in claim 4, wherein the method further comprises:

ejecting ink droplets directly onto a recording medium to print said image thereon, said ejecting of ink droplets being accomplished in two or more passes, and each of the pixels of said image being addressed only once for printing by said print head.

11. The method of printing as claimed in claim 4, wherein said step of checking said print head for a new nozzle failure further comprises:

printing a test patch by said print head at an inter-document zone; and scanning said test patch for missing pixels indicative of a failed nozzle.

12. An ink jet printer having a print head with an array of nozzles capable of compensating for a failed nozzle, comprising:

a print head having an array of droplet ejecting nozzles, including partial nozzle redundancy;

a controller for causing said print head to eject ink droplets from all of said nozzles during a printing operation at an ejection throughput of about 0.5 to 0.8 of a maximum available throughput of said print head;

a memory for storing failed nozzle information that is accessible by said controller;

sensing apparatus for identifying a failed nozzle in said array of nozzles and generating failed nozzle information for storage in said memory; and said controller accessing said memory to check for failed nozzle information, and upon finding failed nozzle information, implementing a procedure that causes non-failed nozzles that print pixels adjacent missing pixels intended to be printed by said failed nozzle to increase their ejection throughput and print available blank pixels nearest to said missing pixels intended to be printed by said failed nozzle, in order to mitigate the visible effect produced by said failed nozzles and prevent loss of productivity.

13. The ink jet printer as claimed in claim 12, wherein said print head is a full width print head that is parallel to and confronts a rotatable intermediate transfer drum; wherein said print head ejects ink droplets from said array of nozzles onto said intermediate transfer drum as said intermediate transfer drum is rotated there past to print an image thereon for subsequent transfer to a recording medium; and wherein said image printed on said intermediate transfer drum is comprised of pixels, each of which pixels may be addressed only once for printing by said print head.

14. The ink jet printer as claimed in claim 12, wherein said print head is stationary and said image is printed in a single pass.

15. The ink jet printer as claimed in claim 12, wherein said print head is translatable and said image is printed in two or more passes.

16. The ink jet printer as claimed in claim 12, wherein said procedure implemented by said controller renders the image to dots using an adaptive rendering method.

17. The ink jet printer as claimed in claim 16, wherein said adaptive rendering method is error diffusion.

18. The ink jet printer as claimed in claim 12, wherein the sensing apparatus comprises an optical sensor for scanning a test patch produced by said print head in an inter-document zone, said optical sensor identifying missing pixels in said test patch that represent a failed nozzle and forwarding information identifying said failed nozzle to said memory.

19. The ink jet printer as claimed in claim 18, wherein the controller, upon finding failed nozzle information, causing said print head to incur a routine maintenance to correct said failed nozzle, if said failed nozzle cannot be corrected by routine maintenance, said controller implements said procedure to cause non-failed nozzles that print pixels adjacent missing pixels intended to be printed by said failed nozzle to increase their ejection throughput.

20. The printer as claimed in claim 12, wherein said controller increases ejection throughput of said non-failed nozzles that print pixels adjacent said missing pixels to a maximum available throughput whenever said missing pixels identified to be printed by said failed nozzle are to be printed in a substantially dark fill.

21. An ink jet printer having a print head with an array of nozzles capable of compensating for a failed nozzle, comprising:

a print head having rows of equally spaced nozzles, a number of said nozzles being redundant, so that different ones of said nozzles may not eject an ink droplet during a printing operation;

a controller for causing said print head to eject ink droplets from said rows of nozzles at an ejection throughput of about 0.5 to 0.8 of a maximum available throughput of said print head;

a memory for storing failed nozzle information, the memory being accessible by said controller for checking on said failed nozzle information;

sensing apparatus for identifying any new failed nozzle and effecting print head maintenance to clear said failed nozzle, said sensing apparatus generating failed nozzle information for updating said failed nozzle information stored in said memory whenever said print head maintenance cannot clear said newly identified failed nozzle; and said controller implementing a procedure that causes non-failed nozzles that print pixels adjacent missing pixels intended to be printed by a failed nozzle to increase their ejection throughput and print available blank pixels nearest to said missing pixels intended to be printed by said failed nozzle, thereby mitigating the visible effect produced by said failed nozzle and preventing loss of productivity.

* * * * *